US010746142B2

(12) United States Patent
Senda

(10) Patent No.: US 10,746,142 B2
(45) Date of Patent: Aug. 18, 2020

(54) AIR INTAKE APPARATUS

(71) Applicant: AISIN SEIKI KABUSHIKI KAISHA, Kariya-shi, Aichi-ken (JP)

(72) Inventor: Tomohisa Senda, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 17 days.

(21) Appl. No.: 16/267,603

(22) Filed: Feb. 5, 2019

(65) Prior Publication Data

US 2019/0277230 A1 Sep. 12, 2019

(30) Foreign Application Priority Data

Mar. 6, 2018 (JP) ..... 2018-039741

(51) Int. Cl.
*F02M 35/10* (2006.01)
*F02M 35/112* (2006.01)

(52) U.S. Cl.
CPC ..... *F02M 35/112* (2013.01); *F02M 35/1038* (2013.01); *F02M 35/10052* (2013.01); *F02M 35/10078* (2013.01); *F02M 35/10157* (2013.01); *F02M 35/10209* (2013.01); *F02M 35/10373* (2013.01)

(58) Field of Classification Search
CPC ..... F02M 35/112; F02M 35/10052; F02M 35/10078; F02M 35/10157; F02M 35/10209; F02M 35/1038; F02M 35/10373; F02M 35/10386; F02M 35/10393
See application file for complete search history.

(56) References Cited

U.S. PATENT DOCUMENTS 6,016,781 A * 1/2000 Toyama ..... F02B 77/08 123/184.42
2013/0213338 A1* 8/2013 Lim ..... G01L 19/0681 123/184.21
2014/0041614 A1* 2/2014 Koyama ..... F02M 35/10039 123/184.21

FOREIGN PATENT DOCUMENTS

JP 2012062773 A 3/2012
JP 2017145792 A 8/2017
WO 2005095776 A1 10/2005

* cited by examiner

*Primary Examiner* — Jacob M Amick
(74) *Attorney, Agent, or Firm* — Buchanan Ingersoll & Rooney PC

(57) ABSTRACT

An air intake apparatus includes an air intake apparatus body including an intake passage and a detection bore, a sensor holding portion holding a sensor, a pipe member constituted by an elastic member and including a first end and a second end, the first end being connected to the detection bore and the second end being connected to the sensor holding portion, the sensor holding portion including a fitting portion which includes an inner peripheral portion contactable with an outer peripheral portion of the second end, the sensor and the pipe member being fixed to the sensor holding portion by a contact of the outer peripheral portion of the second end with the inner peripheral portion of the fitting portion in a state where an insertion portion of the sensor is inserted to be positioned within the second end of the pipe member to widen the second end.

20 Claims, 12 Drawing Sheets

AIR INTAKE APPARATUS

CROSS REFERENCE TO RELATED APPLICATIONS

This application is based on and claims priority under 35 U.S.C. § 119 to Japanese Patent Application 2018-039741, filed on Mar. 6, 2018, the entire content of which is incorporated herein by reference.

TECHNICAL FIELD

This disclosure generally relates to an air intake apparatus.

BACKGROUND DISCUSSION

An air intake apparatus including a sensor holding portion which holds a sensor is known. Such air intake apparatus is disclosed, for example, in JP2012-62773A which is hereinafter referred to as Reference 1.

Reference 1 discloses a construction including a resin-made intake manifold (an air intake apparatus body) through which air flows, the air being introduced to an inside of an engine, a pressure sensor measuring a fluid pressure within the intake manifold, a hose communicating between the pressure sensor and the inside of the intake manifold, and a fixation portion and a positioning portion which are provided for mounting the pressure sensor at the intake manifold. In the aforementioned construction, the fixation portion and the positioning portion are provided at an outer surface of the intake manifold. The pressure sensor is held at the intake manifold in a state of being fixed and fastened by means of a bolt and a nut at the fixation portion and in a state where the positioning portion in a pin form is fitted into an engagement bore formed at the pressure sensor.

In the aforementioned construction of Reference 1, because the pressure sensor is necessarily fastened and fixed by means of the bolt and the nut at the fixation portion, a process for fixing the pressure sensor to the intake manifold (i.e., a process for stabilizing the pressure sensor) may take time. In a case where the pressure sensor is not fastened or fixed by means of the bolt and the nut at the fixation portion, for example, required time for the process of fixing the pressure sensor at the fixation portion may be restrained from increasing. Nevertheless, the fixation between the pressure sensor and the intake manifold may be insufficient in a state where only the positioning portion is fitted into the engagement bore of the pressure sensor. Because of such insufficient fixation, a clearance may be generated between the pressure sensor and the intake manifold. In this case, looseness of the pressure sensor relative to the intake manifold, which leads to vibration, may cause decrease of detection accuracy of the pressure sensor.

A need thus exists for an air intake apparatus which is not susceptible to the drawback mentioned above.

SUMMARY

According to an aspect of this disclosure, an air intake apparatus includes an air intake apparatus body including an intake passage which is connected to a combustion chamber of an internal combustion engine body to supply an intake air to the combustion chamber and a detection bore communicating between the intake passage and an outside of the air intake apparatus body, a sensor holding portion provided at the outside of the air intake apparatus body to hold a sensor which measures a state of an intake air flowing through the intake passage, a pipe member constituted by an elastic member and including a first end and a second end, the first end being connected to the detection bore and the second end being connected to the sensor holding portion, the sensor holding portion including a fitting portion which includes an inner peripheral portion contactable with an outer peripheral portion of the second end of the pipe member, the sensor and the pipe member being fixed to the sensor holding portion by a contact of the outer peripheral portion of the second end of the pipe member with the inner peripheral portion of the fitting portion in a state where an insertion portion of the sensor is inserted to be positioned within the second end of the pipe member to widen the second end.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment is explained with reference to the attached drawings.

A construction of an engine 1 at which an intake manifold 6 of an air intake apparatus 100 according to an embodiment is attached is explained with reference to FIGS. 1 to 10. The intake manifold 6 serves as an example of an air intake apparatus body.

Figure 1:
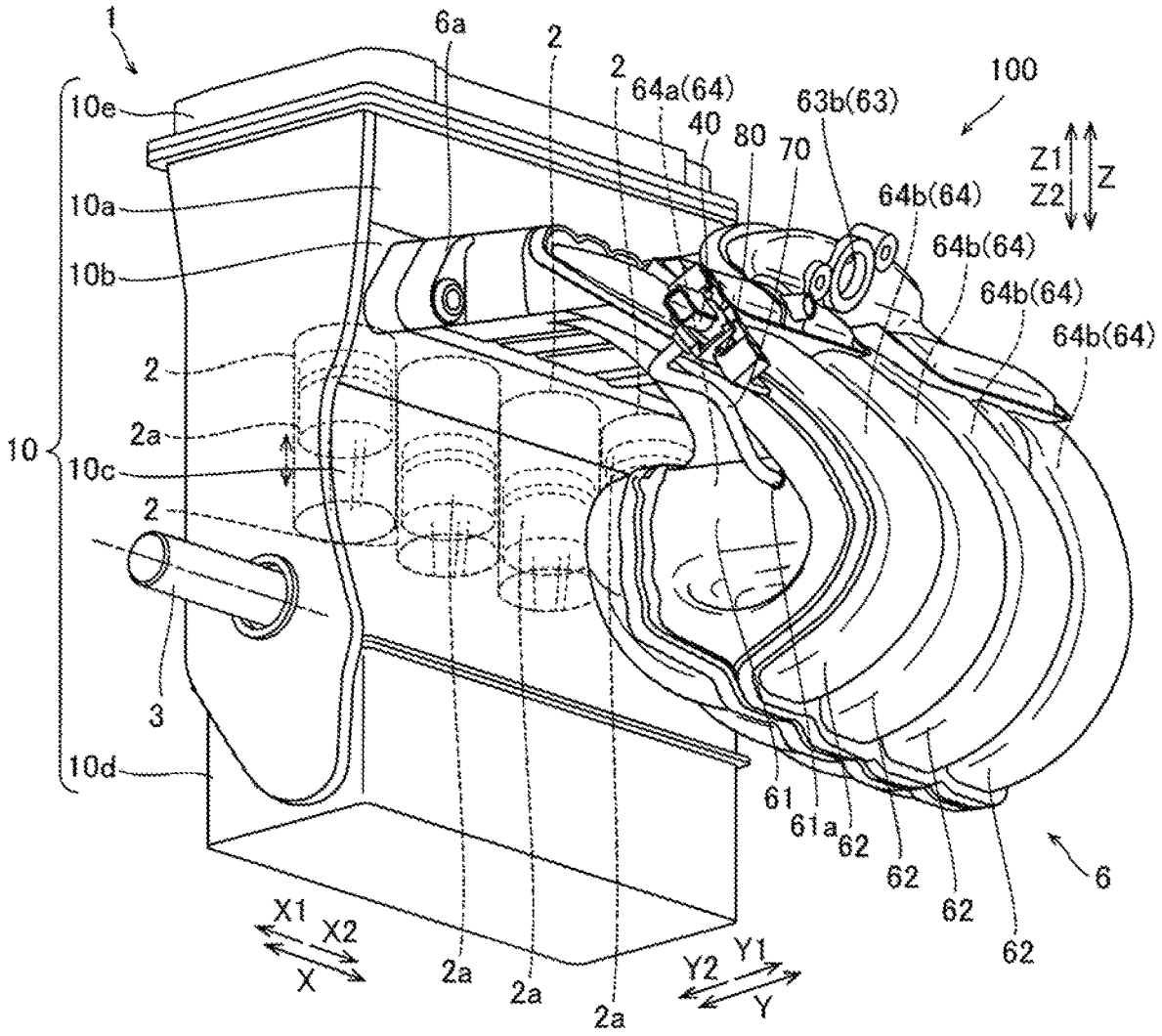
FIG. 1 is a perspective view schematically illustrating an entire construction of an engine at which an air intake apparatus is mounted according to an embodiment disclosed here.

As illustrated in FIG. 1, the engine 1 for a vehicle (for example, an automobile) is constructed in a way that pistons 2*a* move up and down (reciprocate) within respective plural cylinders (for example, four cylinders) 2 extending in an up-down direction to cause a crankshaft 3 to rotate by continuously repeating a cycle constituted by intake, compression, expansion (combustion), and exhaust. A direction where the crankshaft 3 extends in the engine 1 is defined as an X direction and a direction orthogonal to the X direction on a horizontal plane is defined as a Y direction. A direction orthogonal to the X direction and the Y direction in the engine 1, i.e., a direction where the cylinders 2 extend, is defined as a Z direction (in the up-down direction).

Specifically, the engine 1 includes an engine body 10 serving as an example of an internal combustion engine body made of aluminum alloy. The engine body 10 includes a cylinder block 10*a*, a cylinder head 10*b*, a crankcase 10*c*, an oil pan 10*d*, and a head cover 10*e*. The cylinder head 10*b* is tightened to an upper surface (at a Z1 side) of the cylinder block 10*a*. The crankcase 10*c* is tightened to a lower surface (at a Z2 side) of the cylinder block 10*a*. The oil pan 10*d* is tightened to a lower surface of the crankcase 10*c*. The head cover 10*e* is tightened to an upper portion of the cylinder head 10*b* to cover the cylinder head 10*b*. The crankshaft 3 is arranged at the crankcase 10*c*. The crankshaft 3 extends in an arrangement direction of the cylinders 2 (i.e., in the X direction).

The cylinder head 10*b* made of aluminum alloy includes combustion chambers 5 (see FIG. 2), intake ports 51 (see FIG. 2) sending intake air (air and EGR gas mixture) to the combustion chambers 5, and discharge ports discharging burned gas as exhaust gas. The intake ports 51, the combustion chambers 5, and the discharge ports are arranged at the cylinder head 10*b* so as to correspond to the respective cylinders 2 at the cylinder block 10*a*.

The air intake apparatus 100 is mounted at the engine 1. The air intake apparatus 100 includes the intake manifold 6 connected to the cylinder head 10*b* of the engine body 10 and a throttle valve 7 (see FIG. 2) regulating an amount of outside air (atmospheric air) supplied to the intake manifold 6.

Figure 3:
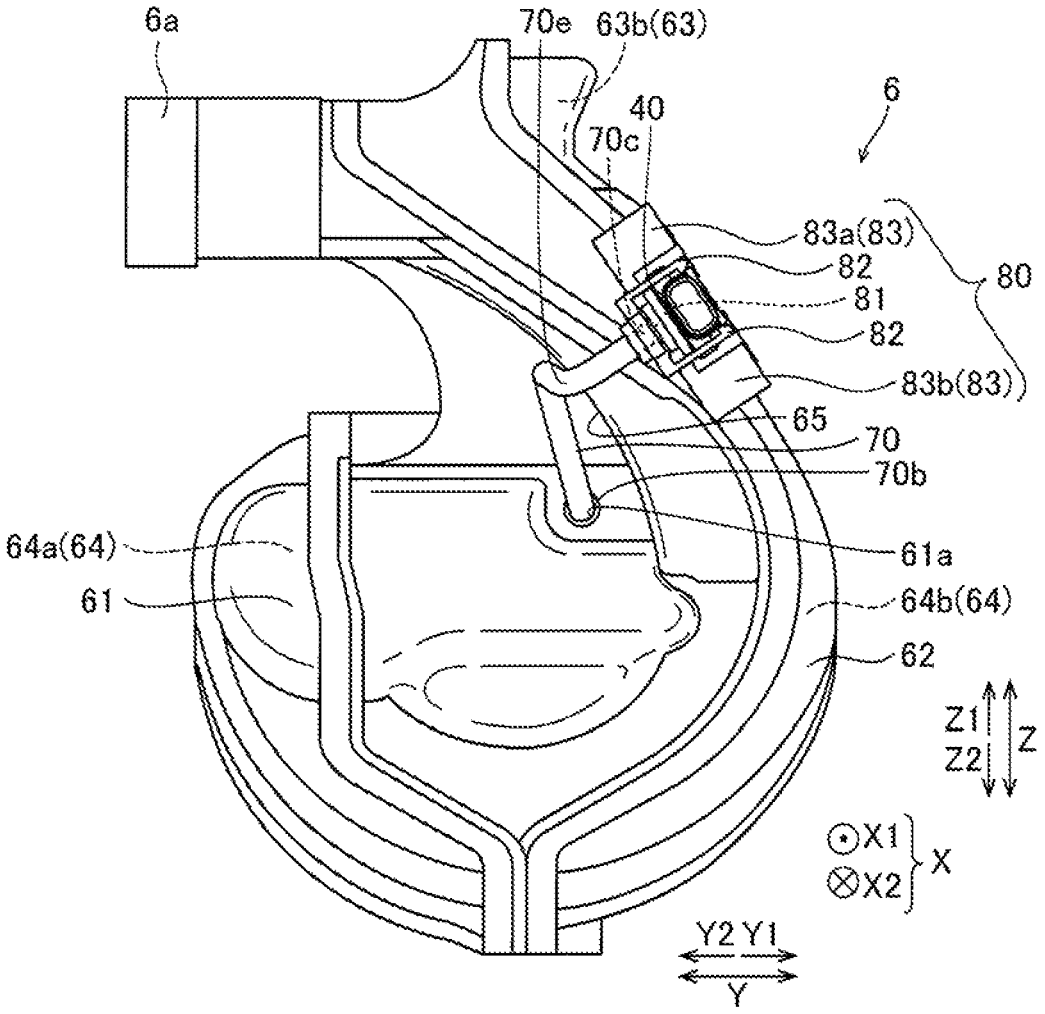
FIG. 3 is a plan view illustrating an intake manifold of the air intake apparatus according to the embodiment.

As illustrated in FIGS. 1 and 3, the intake manifold 6 includes a surge tank portion 61, plural intake pipe portions (for example, four intake pipe portions) 62 connected to a downstream side of the surge tank portion 61, and an EGR gas distribution portion 63. The surge tank portion 61, the intake pipe portions 62, and the EGR gas distribution portion 63 are made from resin material such as nylon 6 where glass fibers are dispersed, for example. In addition, the surge tank portion 61, the intake pipe portions 62, and the EGR gas distribution portion 63 are integrally formed by vibration welding of plural resin members, for example.

The intake manifold 6 includes a flange portion 6*a* which is arranged, bridging over downstream end portions of the plural intake pipe portions 62. The flange portion 6*a* is connected and fixed to the engine body 10 in a state of making contact with a side surface of the cylinder head 10*b*. The plural intake pipe portions 62 are arranged along the arrangement direction of the cylinders 2 (i.e., the X direction).

Figure 2:
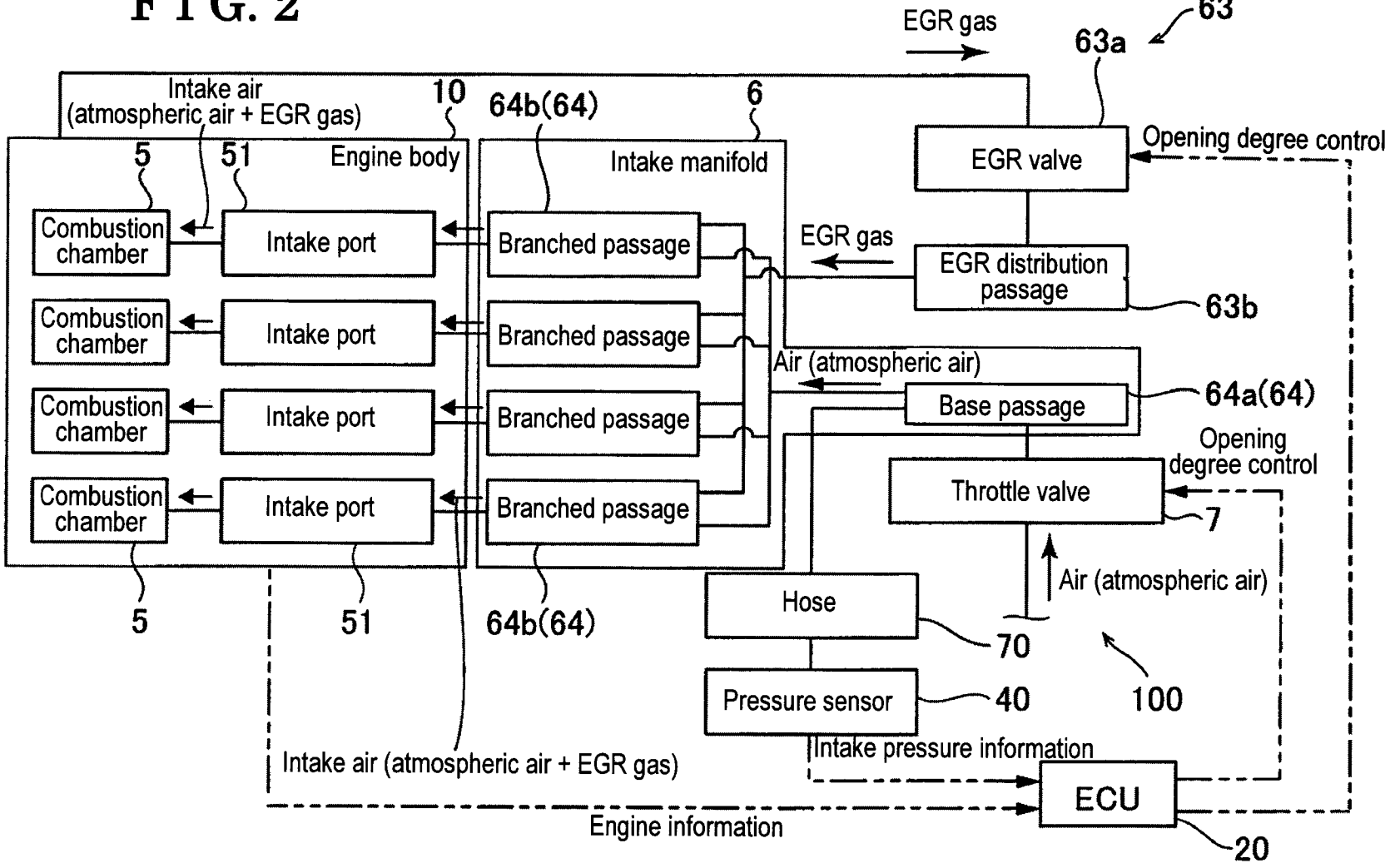
FIG. 2 is a block diagram explaining the engine at which the air intake apparatus is mounted according to the embodiment.

The intake manifold 6 includes an intake passage 64 through which intake air (atmospheric air or air-fuel mixture) flows. The intake passage 64 includes a base passage 64*a* formed within the surge tank portion 61 and plural (for example, four) branched passages 64*b* formed within the respective plural (four) intake pipe portions 62 and branched from the base passage 64*a*. As illustrated in FIG. 2, the intake passage 64 functions to distribute air (intake air) to the respective combustion chambers 5 via the plural intake ports 51 by distributing the intake air which is introduced to the base passage 64*a* to the respective branched passages 64*b*. At this time, the base passage 64*a* is arranged at an upstream side in an air intake direction and the branched passages 64*b* are arranged at a downstream side in the air intake direction.

As illustrated in FIG. 1, an outer surface of the surge tank portion 61 at an X1 side is positioned closer to an X2 side than an outer surface of the intake pipe portion 62 which is positioned at the most X1 side among the four intake pipe portions 62. That is, as viewed from the X1 side, the surge tank portion 61 is arranged being dented towards the X2 side from the intake pipe portion 62 which is positioned at the most X1 side.

A detection bore 61*a* is provided at the surge tank portion 61 so as to communicate between the base passage 64*a* and an outside of the intake manifold 6. The detection bore 61*a* is arranged extending through a lateral surface of the surge tank portion 61 at the X1 side in the X direction. The detection bore 61*a* is provided at a position at a back side (i.e., towards the X2 side) relative to the intake pipe portion 62 positioned at the most X1 side.

The EGR gas distribution portion 63 is provided to introduce and recirculate a part of exhaust gas discharged from the discharge ports at the engine body 10 to the intake passage 64 of the intake manifold as exhaust gas recirculation (EGR) gas. Specifically, as illustrated in FIG. 2, an EGR distribution passage 63*b* through which the EGR gas flows is provided inside the EGR gas distribution portion 63. An EGR valve 63*a* is provided at an upstream side than the EGR gas distribution portion 63 so that an opening degree of the EGR valve 63*a* is controlled by an engine control unit (ECU) 20. The EGR valve 63*a* includes a function to control a supply amount of EGR gas supplied to the branched passages 64*b* of the intake passage 64 in a state where the opening degree of the EGR valve 63*a* is regulated. The EGR distribution passage 63*b* includes a function to distribute the EGR gas which has passed through the EGR valve 63*a* to the respective branched passages 64*b* of the intake manifold 6.

The throttle valve 7 is configured to control a supply amount of atmospheric air supplied to the base passage 64*a* of the intake passage 64 in a state where an opening degree of the throttle valve 7 is regulated by the ECU 20.

Figure 4:
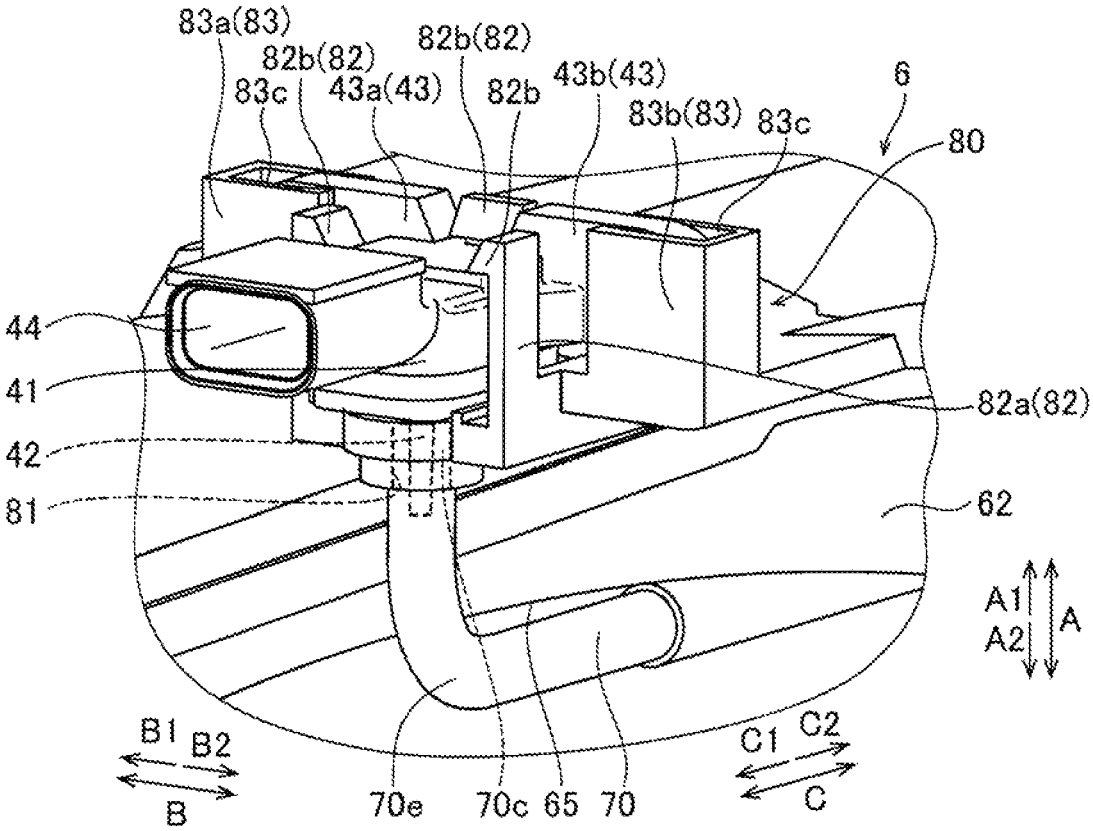
FIG. 4 is a perspective view illustrating a sensor holding portion and a pressure sensor which is held at the sensor holding portion of the air intake apparatus according to the embodiment.
Figure 5:
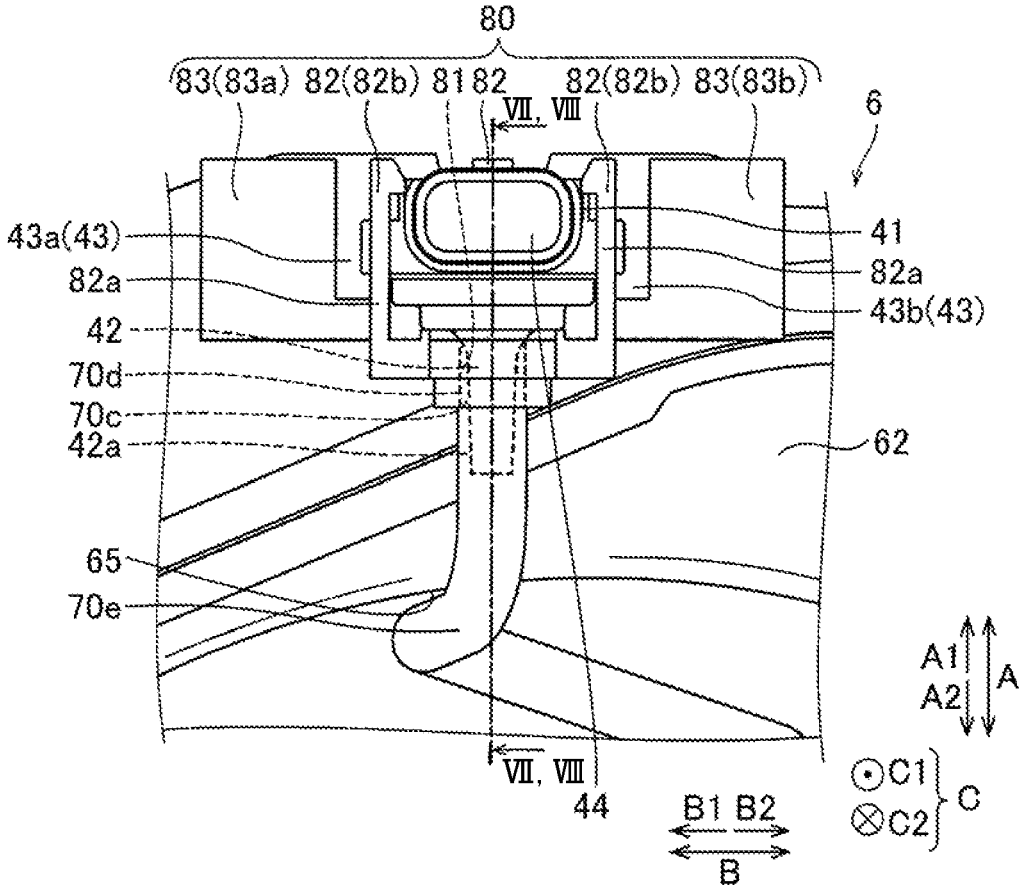
FIG. 5 is a plan view illustrating the sensor holding portion and the pressure sensor which is held at the sensor holding portion of the air intake apparatus according to the embodiment.

As illustrated in FIGS. 4 and 5, a pressure sensor 40 serving as an example of a sensor is mounted and fixed at the intake manifold 6 via a sensor holding portion 80. The pressure sensor 40 includes a function to measure a pressure (serving as an example of an intake pressure and an intake air) within the base passage 64*a* of the surge tank portion 61 via a hose 70.

As illustrated in FIG. 2, the pressure sensor 40 sends a detection result of intake pressure as intake pressure information to the ECU 20. The ECU 20 controls the opening degree of each of the throttle valve 7 and the EGR valve 63*a*, and fuel injection volume of an injector of the engine 1 based on the intake pressure information and other information such as engine information including an engine speed, for example.

Figure 6:
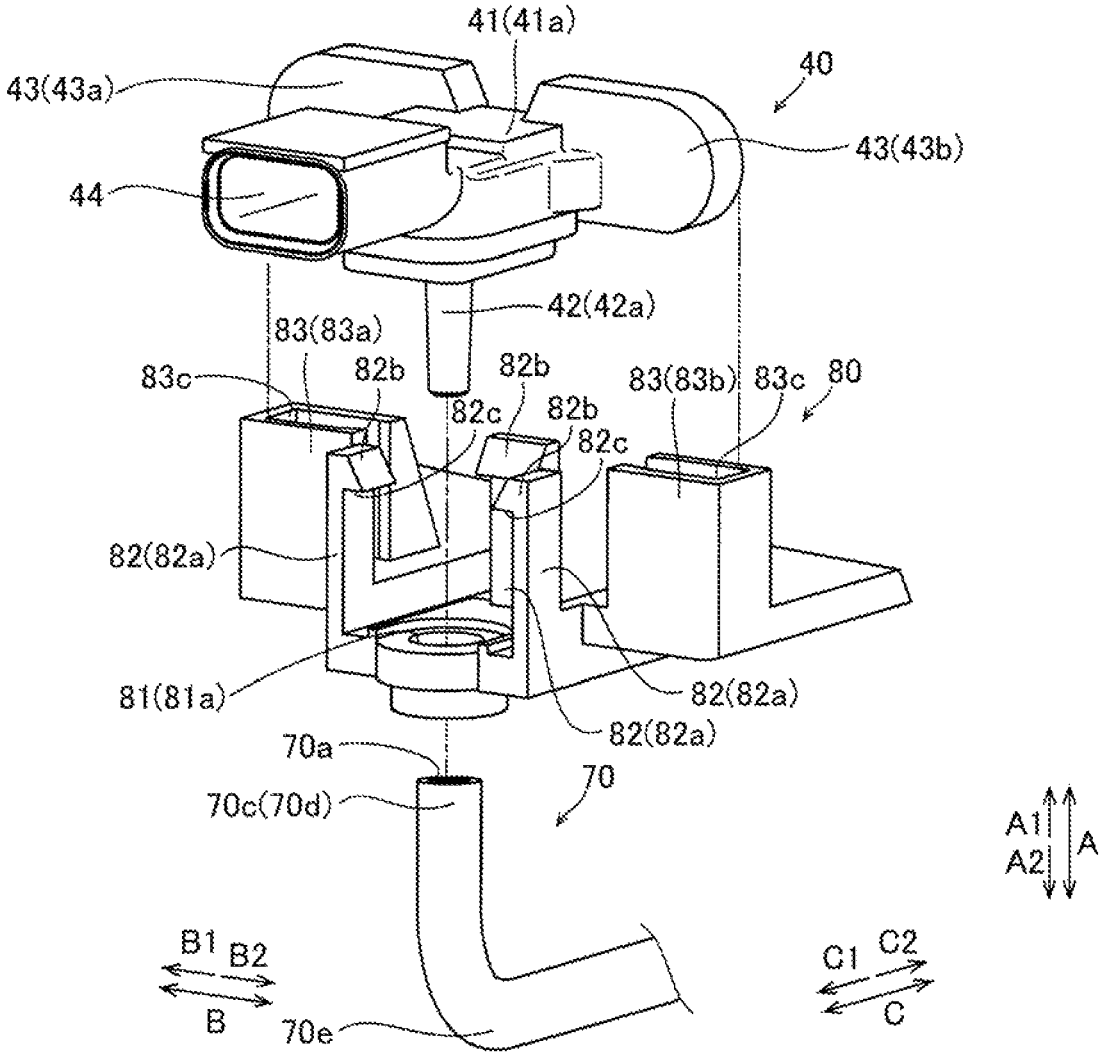
FIG. 6 is an exploded perspective view illustrating a hose and the sensor holding portion of the air intake apparatus, and the pressure sensor according to the embodiment.

The pressure sensor 40 includes a sensor body 41 in a cuboid form, an insertion portion 42 integrally provided at the sensor body 41, flange portions 43, and a connection portion 44 as illustrated in FIG. 6. The sensor body 41, the insertion portion 42, the flange portions 43, and the connection portion 44 are integrally formed by resin molding. The sensor body 41, the insertion portion 42, the flange portions 43, and the connection portion 44 are formed of resin harder than resin which forms the intake manifold 6. In FIG. 6, the sensor holding portion 80 is taken out from the intake manifold 6 for easy understanding.

In FIG. 6, a direction where the pressure sensor 40, the sensor holding portion 80, and the hose 70 are arranged is defined as an A direction. The pressure sensor 40 and the hose 70 are provided at an A1 direction and an A2 direction, respectively. The A2 direction serves as an example of an insertion direction. The A1 direction serves as an example of an opposite direction to the insertion direction. A direction where the flange portions 43 extend is defined as a B direction and a thickness direction of each of the flange portions 43 is defined as a C direction among directions orthogonal to the direction A. The B direction serves as an example of a first direction. The C direction serves as an example of a second direction.

An element of which output voltage changes due to magnitude of pressure is arranged within the sensor body 41. The insertion portion 42 protrudes in the A2 direction from the sensor body 41. The insertion portion 42 is formed in a hollow cylindrical form. The insertion portion 42 in a cylindrical form is configured to be inserted into the hose 70 in the direction A2. In a state where the insertion portion 42 is inserted to be positioned within the hose 70, the atmospheric air (intake air) within the hose 70 is supplied to the inside of the sensor body 41. That is, the pressure sensor 40 is inhibited from being fitted or inserted to the intake manifold 6 to directly measure the intake pressure at the intake passage 64 (i.e., the pressure sensor 40 is not of a direct-measurement type) and is configured to measure the intake pressure at the intake passage 64 via the hose 70 while being positioned away from the intake passage 64. Because of such configuration, as compared to a pressure sensor of direct-measurement type, mounting position and detection accuracy of the pressure sensor 40 are not necessary to be strictly secured, so that the pressure sensor 40 may be easily mounted at the intake manifold 6.

The flange portions 43 include a first flange portion 43*a* protruding from the sensor body 41 in a B1 direction and a second flange portion 43*b* protruding from the sensor body 41 in a B2 direction as illustrated in FIG. 6. The flange portion 43 is formed in a plate form including a thickness in the C direction. A terminal is mounted at the connection portion 44 for electrically connecting the ECU 20 and the sensor body 41.

The air intake apparatus 100 includes the aforementioned hose 70 serving as an example of a pipe member. The hose 70 is a hollow pipe made from an elastic material such as ethylene propylene diene rubber (EPDM), for example (i.e., constituted by an elastic member). The hose 70 includes an inner passage 70*a* through which atmospheric air (intake air) flows. The elastic member constituting the hose 70 is softer than resin forming the sensor body 41, the insertion portion 42, the flange portions 43, and the connection portion 44 and resin forming the intake manifold 6.

Figure 7:
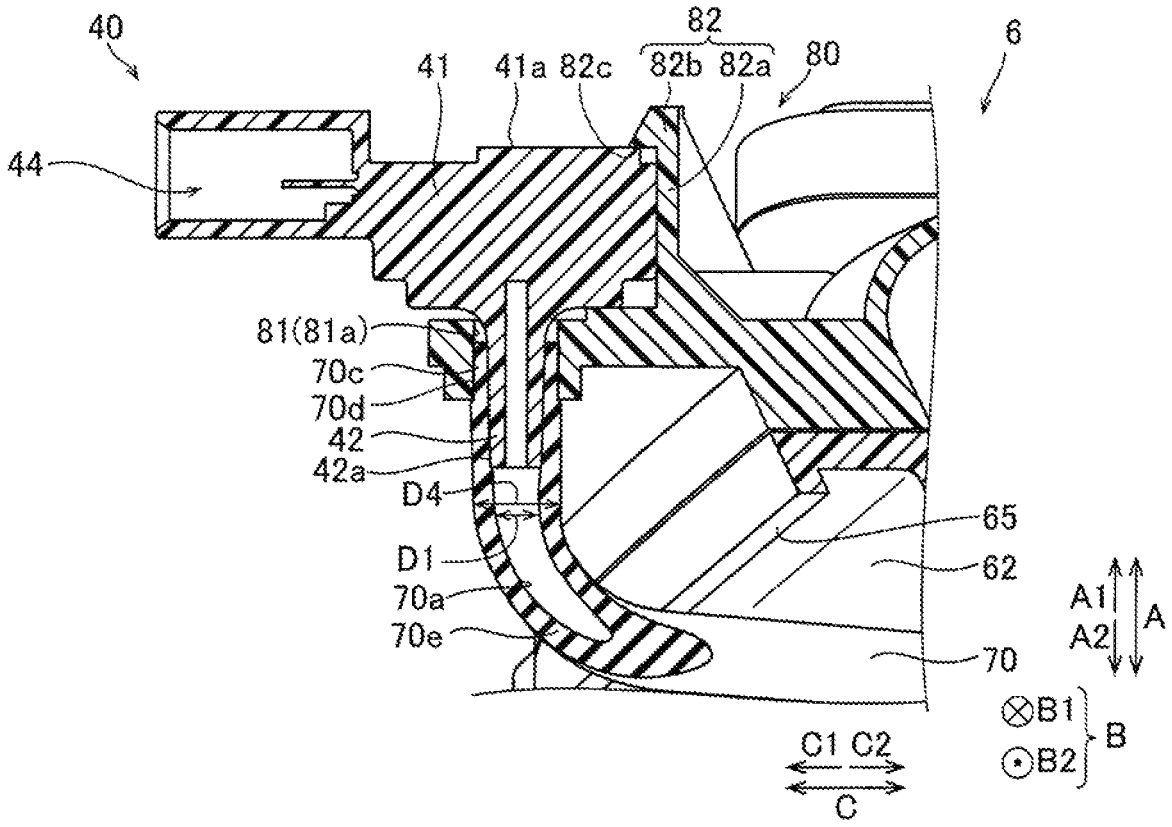
FIG. 7 is a cross-sectional view taken along a line VII, VIII-VII, VIII in FIG. 5.
Figure 8:
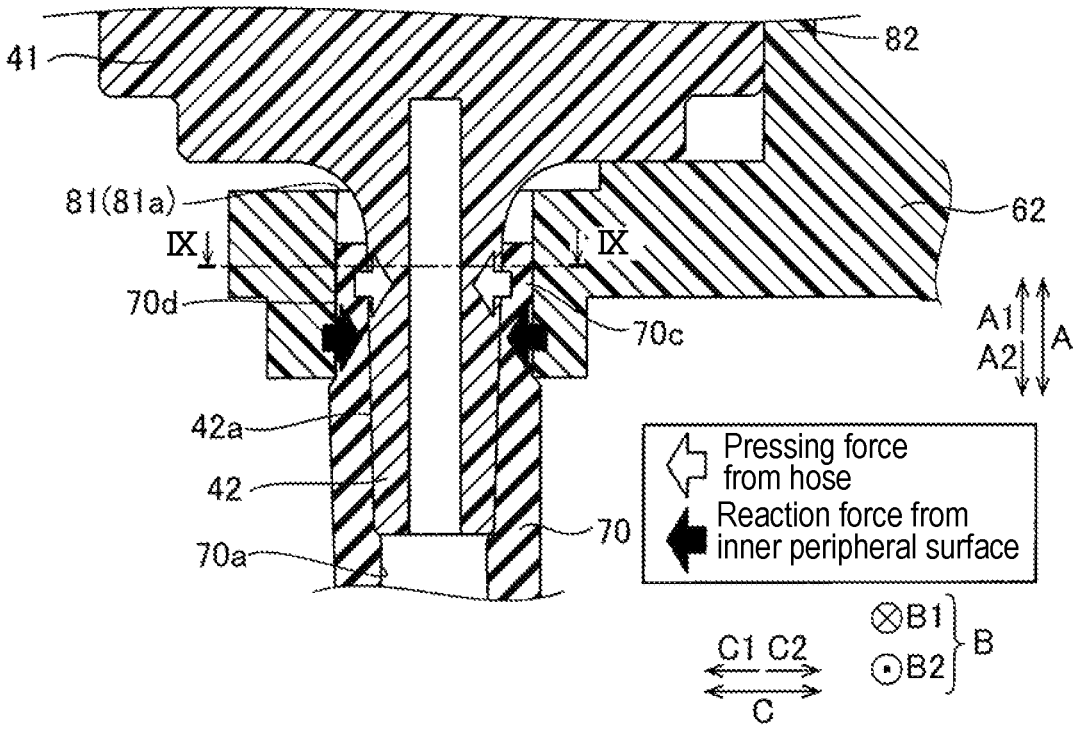
FIG. 8 is an enlarged cross-sectional view taken along the line VII, VIII-VII, VIII in FIG. 5.

As illustrated in FIG. 3, the hose 70 includes a first end 70*b* that is connected to the detection bore 61*a* from an outside of the intake manifold 6. Accordingly, a pressure at the inner passage 70*a* of the hose 70 is equalized to a pressure (intake pressure) at the base passage 64*a*. The pressure sensor 40 arranged at a position away from the base passage 64*a* serving as a measurement portion is thus able to measure the intake pressure at the base passage 64*a*. The hose 70 also includes a second end 70*c* that is retained and held at the sensor holding portion 80 in a state where the insertion portion 42 of the pressure sensor 40 is inserted to be positioned within the hose 70 as illustrated in FIGS. 7 and 8. At this time, the second end 70*c* of the hose 70 corresponds to an end portion and its vicinity opposite to the first end 70*b* of the hose 70. The hose 70 includes an inner diameter D1 which is entirely substantially constant in a state before the insertion portion 42 is inserted to be positioned within the hose 70 (i.e., before the hose 70 is pushed out and widened).

Figure 9:
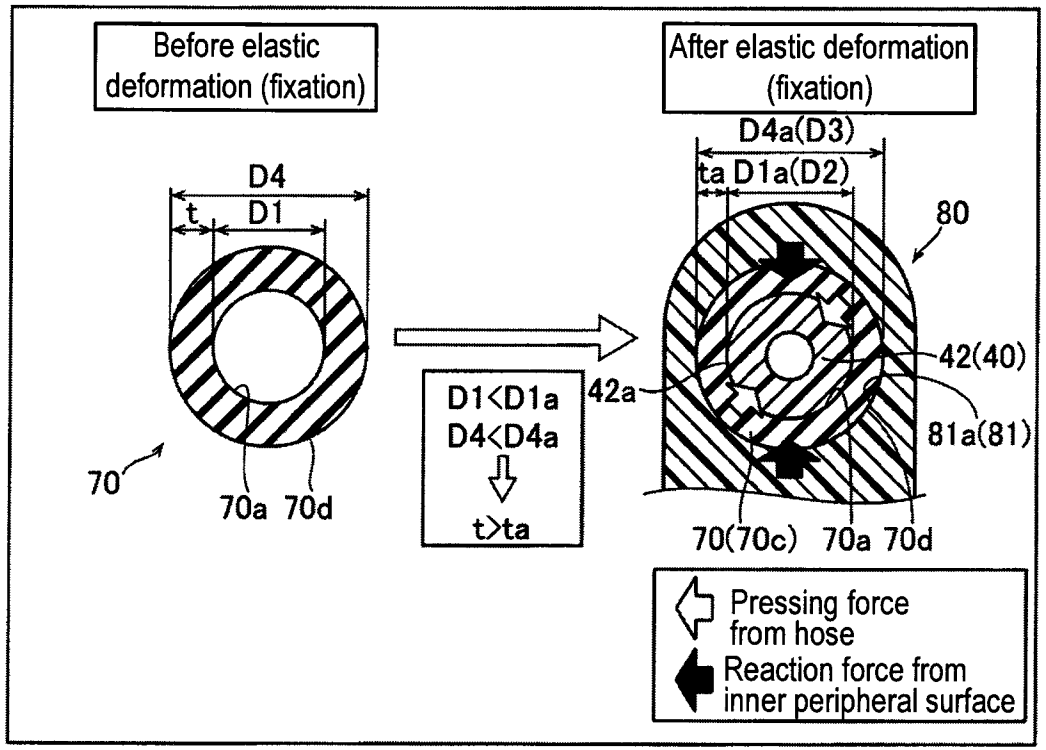
FIG. 9 is a cross-sectional view of the hose which is not yet elastically deformed and a cross-sectional view taken along a line IX-IX in FIG. 8 and illustrating the hose, the sensor holding portion, and the pressure sensor after the hose is elastically deformed.

As illustrated in FIG. 9, the inner diameter D1 of the hose 70 in a state before the insertion portion 42 is inserted to be positioned within the hose 70 (i.e., before the hose 70 is widened) is smaller than an outer diameter D2 of the insertion portion 42 of the pressure sensor 40 which is harder than the hose 70. Therefore, the hose 70 is configured to be elastically deformed by being pushed out (widened) in a case where the insertion portion 42 is inserted to be positioned within the second end 70*c* of the hose 70.

The air intake apparatus 100 further includes the sensor holding portion 80 provided at the outer side of the intake manifold 6 to hold the pressure sensor 40 as illustrated in FIGS. 3 to 8. The sensor holding portion 80 is provided at the outer surface of one of the intake pipe portions 62 positioned at the most X1 side, so as to be integrally formed therewith. That is, the sensor holding portion 80 is made from the same resin material as that forming the intake manifold 6. The sensor holding portion 80 is integrally entirely formed at one of the plural resin members constituting the intake manifold 6.

The sensor holding portion 80 includes a fitting portion 81 into which the second end 70*c* of the hose 70 is inserted to be positioned, three engagement portions 82 arranged to surround the fitting portion 81, and a pair of retention portions 83 arranged to sandwich the fitting portion 81 in the B direction as illustrated in FIG. 6.

The fitting portion 81 is constituted by a penetration bore which is formed penetrating through a bottom surface of the sensor holding portion 80 at an A2 side in the A direction as illustrated in FIGS. 7 and 8. The fitting portion 81 includes an inner diameter D3 greater than an outer diameter D4 of the hose 70 (for example, an outer diameter of a part of the hose 70 at which elastic deformation is substantially inhibited from occurring and which is positioned at an upstream side than the fitting portion 81) before the hose 70 is elastically deformed as illustrated in FIG. 9. Accordingly, the hose 70 which is not yet elastically deformed may be easily inserted into the fitting portion 81. An inner peripheral surface 81*a* of the fitting portion 81 is contactable with an outer peripheral surface 70*d* of the second end 70*c* of the hose 70. The outer peripheral surface 70*d* serves as an example of an outer peripheral portion.

According to the embodiment, as illustrated in FIGS. 7 to 9, the pressure sensor 40 is fixed to the sensor holding portion 80 by the outer peripheral surface 70*d* of the second end 70*c* of the hose 70 making contact with the inner peripheral surface 81*a* of the fitting portion 81 in a state where the insertion portion 42 of the pressure sensor 40 is inserted to be positioned within the second end 70*c* of the hose 70 which is thus pushed out and widened.

Figure 10:
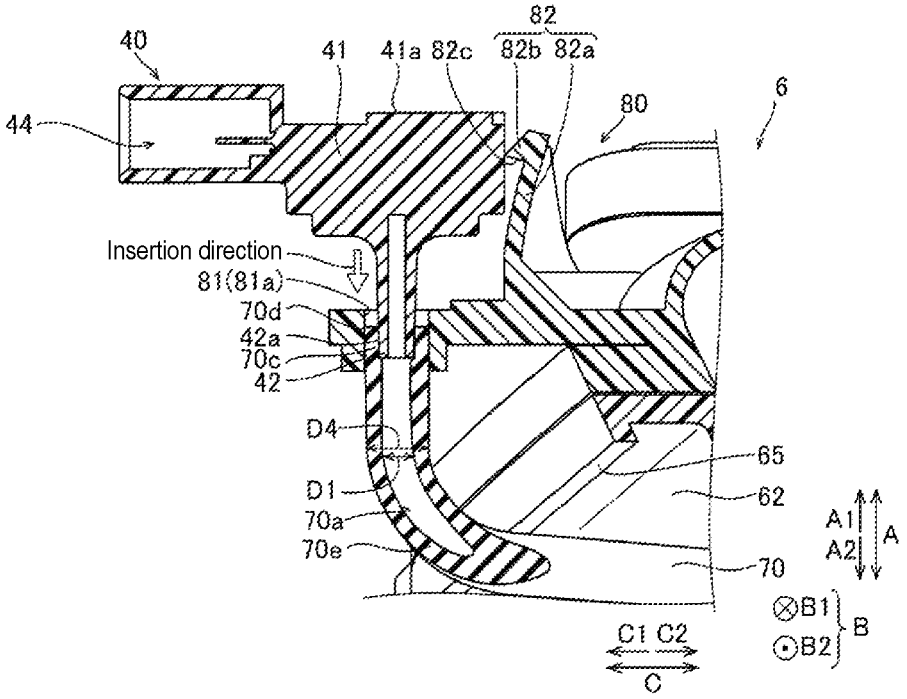
FIG. 10 is a cross-sectional view illustrating the pressure sensor and the air intake apparatus in a process of fixing the pressure sensor to the air intake apparatus according to the embodiment.

Specifically, as illustrated in FIG. 6, the insertion portion 42 of the pressure sensor 40 is inserted into the inner passage 70*a* of the second end 70*c* of the hose 70 in a state where the second end 70*c* of the hose 70 is inserted from the A2 side to be positioned within the fitting portion 81. Accordingly, a pressing force in an inward direction for pressing an outer peripheral surface 42*a* of the insertion portion 42 is generated at the second end 70*c* of the hose 70 which is elastically deformed by being pushed out and widened as illustrated in FIG. 10.

Further, the outer peripheral surface 70*d* of the second end 70*c* of the hose 70 which is pushed out and widened makes contact with the inner peripheral surface 81*a* of the fitting portion 81 to thereby restrain further deformation of the hose 70 and to thereby apply a reaction force against the aforementioned pressing force to the hose 70 from the inner peripheral surface 81*a*. At this time, an inner diameter D1*a* of the hose 70 which is pushed out (widened) is substantially equal to the outer diameter D2 of the insertion portion 42 of the pressure sensor 40 and thus is greater than the inner diameter D1 of the hose 70 before the hose 70 is pushed out. An outer diameter D4*a* of the hose 70 which is pushed out is substantially equal to the inner diameter D3 of the fitting portion 81 and is thus greater than the outer diameter D4 of the hose 70 obtained before the hose 70 pushed out. Thus, a thickness to (=(D4*a*−D1*a*)/2) of the second end 70*c* of the hose 70 which is pushed out is smaller than a thickness t (=(D4−D1)/2) of the second end 70*c* of the hose 70 obtained before the hose 70 is pushed out. The pressing force based on the elastic deformation of the hose 70 is applied to the inner peripheral surface 81*a* of the fitting portion 81 from the hose 70.

Accordingly, the second end 70*c* of the hose 70 is fixed to the fitting portion 81 of the sensor holding portion 80 and the pressure sensor 40 is fixed to the fitting portion 81 of the sensor holding portion 80 via the second end 70*c* of the hose 70.

The three engagement portions 82 are provided at the B1 side, the B2 side, and the C2 side of the fitting portion 81, respectively, as illustrated in FIGS. 4 to 6. Specifically, a pair of engagement portions 82 is provided to face each other in the B direction orthogonal to the insertion direction (i.e., A2 direction), and a single engagement portion 82 is provided at the C2 side. The engagement portions 82 are configured to stabilize the pressure sensor 40 (i.e., the engagement portions 82 and the pressure sensor 40 are lockable) by so-called snap-fitting.

Specifically, each of the engagement portions 82 includes a wall portion 82*a* which extends in the A direction from the bottom surface of the sensor holding portion 80 at the A2 side, and a protruding portion 82*b* provided at an end portion of the wall portion 82*a* at the A1 side. The wall portion 82*a* is formed to be elastically deformable to curve opposite to the fitting portion 81 (i.e., curve outward). The protruding portions 82*b* of the three engagement portions 82 are formed to protrude towards the fitting portion 81 (i.e., protrude inward).

As illustrated in FIG. 10, each of the wall portions 82*a* is elastically deformed to curve towards an opposite side to the fitting portion 81 (i.e., to curve outward) by the sensor body 41 making contact with the projecting portion 82*b* in a process of fixing the pressure sensor 40 to the sensor holding portion 80. In a case where the insertion portion 42 is inserted into the hose 70 to be fixed to the sensor holding portion 80, each contact surface 82*c* of the projecting portion 82*b* makes contact and engages with an upper surface 41*a* of the sensor body 41, thereby releasing elastic deformation of the wall portion 82*a*. The upper surface 41*a* serves as an example of an engagement section. The pressure sensor 40 is thus engaged with the sensor holding portion 80 by means of the engagement portions 82.

The pressure sensor 40 is stabilized by fitting the sensor body 41 into a space surrounded by the engagement portions 82 (i.e., a space with a center at which the fitting portion 81 is positioned in a plan view viewed from the A direction) by means of the elastic deformation of the wall portions 82*a*.

Because of possible creep phenomenon generated at the engagement portions 82 made of resin, the engagement of the pressure sensor 40 by the engagement portions 82 may become insufficient, which may lead to a clearance generated between the upper surface 41*a* of the pressure sensor 40 and each of the contact surfaces 82*c* of the engagement portions 82. Nevertheless, according to the embodiment, looseness of the pressure sensor 40 relative to the sensor holding portion 80 resulting from the aforementioned clearance may be restrained by the hose 70 fixed to the fitting portion 81.

The pair of retention portions 83 extends in the A direction from the bottom surface of the sensor holding portion 80 at the A2 side. The pair of retention portions 83 includes a first retention portion 83*a* provided at the B1 side relative to the fitting portion 81 and a second retention portion 83*b* provided at the B2 side relative to the fitting portion 81. Each of the first retention portion 83*a* and the second retention portion 83*b* includes a C-shaped configuration opening inwardly (towards the fitting portion 81) as viewed in the A direction. Each of the first retention portion 83*a* and the second retention portion 83*b* also includes an opening at the A1 side. The first retention portion 83*a* and the second retention portion 83*b* include receiving portions 83*c* into which the first flange portion 43*a* and the second flange portion 43*b* of the pressure sensor 40 are inserted respectively in the A1 direction.

The first retention portion 83*a* and the second retention portion 83*b* are configured to retain and sandwich the first flange portion 43*a* and the second flange portion 43*b* which are inserted to be positioned within the respective receiving portions 83*c* in the C direction.

The surge tank portion 61 is dented to the X2 side relative to the intake pipe portion 62 which is positioned at the most X1 side as viewed from the X1 side, so that the outer surface of the surge tank portion 61 and the outer surface of the intake pipe portion 62 positioned at the most X1 side are connected to each other via a stepped portion 65. The hose 70 is connected to the detection bore 61*a* provided at the surge tank portion 61 and the fitting portion 81 of the sensor holding portion 80 provided at the outer surface of the intake pipe portion 62 positioned at the most X1 side while curving along the stepped portion 65.

At this time, a curving portion 70*e* curving by approximately 90 degrees is formed at the hose. Specifically, the hose 70 is configured to extend from the second end 70*c* in the A2 direction, to thereafter curve by approximately 90 degrees at the curving portion 70*e*, and to extend in the C2 direction. As a result, the pressure sensor 40 fixed to the hose 70 which is curving receives an elastic force in the C1 direction from the hose 70 so as to release the curving of the hose 70. Thus, the pair of flange portions 43*a* and 43*b* of the pressure sensor 40 is pressed against the inner surfaces of the respective retention portions 83 at the C1 side.

A process for stabilizing the pressure sensor 40 (i.e., a fixing process of the pressure sensor 40) according to the embodiment is explained with reference to FIGS. 4 to 6 and 10.

First, as illustrated in FIG. 6, the second end 70*c* of the hose 70 is inserted into the fitting portion 81 in the A1 direction from the A2 side. Then, the insertion portion 42 of the pressure sensor 40 is inserted into the fitting portion 81 and the hose 70 in the A2 direction from the A1 side. At this time, as illustrated in FIG. 10, the wall portions 82*a* of the engagement portions 82 are elastically deformed in a direction away from the fitting portion 81. The second end 70*c* of the hose 70 where the insertion portion 42 is inserted to be positioned is elastically deformed and the flange portions 43 are retained at the respective receiving portions 83*c* of the retention portions 83.

The elastic deformation of the wall portions 82*a* is released at the time the contact surfaces 82*c* of the engagement portions 82 make contact with the upper surface 41*a* of the sensor body 41. At this time, the pressure sensor 40 and the hose 70 are held at the sensor holding portion 80. Accordingly, as illustrated in FIGS. 4 and 5, the pressure sensor 40 is fixed to the sensor holding portion 80 of the intake manifold 6. The aforementioned fixing process is simplified as compared to a fixing process using a bolt and a nut because of simple insertion of the insertion portion 42 of the pressure sensor 40 into the fitting portion 81 and the hose 70 in the A2 direction from the A1 side. Thus, the fixing process may be reduced and workability may improve.

According to the embodiment, as mentioned above, the pressure sensor 40 and the hose 70 are fixed to the sensor holding portion 80 by the outer peripheral surface 70*d* of the second end 70*c* of the hose 70 making contact with the inner peripheral surface 81*a* of the fitting portion 81 in a state where the insertion portion 42 of the pressure sensor 40 is inserted to be positioned within the second end 70*c* of the hose 70 so that the second end 70*c* is pushed out and widened. Accordingly, the elastic force (tightening force) from the hose 70 which is widened is applied to the insertion portion 42 of the pressure sensor 40 and the reaction force from the inner peripheral surface 81*a* of the fitting portion 81 against the elastic force of the hose 70 is applied to the hose 70 because of the contact of the outer peripheral surface 70*d* of the second end 70*c* of the hose 70 with the inner peripheral surface 81*a* of the fitting portion 81. The elastic force of the hose 70 may be a force for fixing the pressure sensor 40 and the hose 70 to the inside of the fitting portion 81. The pressure sensor 40 and the hose 70 may be securely fixed to the sensor holding portion 80. That is, the insertion portion 42 of the pressure sensor 40 may be fixed to the fitting portion 81 by the elastic force of the hose 70 which attempts to recover to a normal state from a compressed state by bringing the hose 70 positioned between the outer peripheral surface 42*a* of the insertion portion 42 and the inner peripheral surface 81*a* of the fitting portion 81. As a result, the pressure sensor 40 may be sufficiently stabilized (i.e., fixed to the intake manifold 6) without a bolt and a nut.

According to the embodiment, the second end 70*c* of the hose 70 is widened (pushed out) by the insertion portion 42 of the pressure sensor 40, so that a clearance is restrained from being generated between the pressure sensor 40 and the hose 70. In addition, the hose 70 serving as the elastic member makes contact with the inner peripheral surface 81*a* of the fitting portion 81 to thereby restrain a clearance from being generated between the sensor holding portion 80 and the hose 70. Because looseness of the pressure sensor 40 relative to the intake manifold 6 is restrained, decrease of detection accuracy of the pressure sensor 40 resulting from such looseness is restrained.

According to the embodiment, the outer peripheral surface 70*d* of the second end 70*c* of the hose 70 makes contact with the inner peripheral surface 81*a* of the fitting portion 81 in a state where the hose 70 is elastically deformed. Thus, the elastic force of the hose 70 based on its elastic deformation may be securely applied to the inner peripheral surface 81*a* of the fitting portion 81. The reaction force from the inner peripheral surface 81*a* of the fitting portion 81 may be securely applied to the hose 70. The pressure sensor 40 and the hose 70 may be securely fixed to the sensor holding portion 80.

According to the embodiment, the thickness ta of the second end 70*c* of the hose 70 which is pushed out is smaller than the thickness t of the second end 70*c* of the hose 70 obtained before the hose 70 is pushed out. Thus, the elastic force corresponding to change in thickness of the hose 70 (=t−ta) may be securely generated at the second end 70*c* of the hose 70 which is pushed out. The pressure sensor 40 and the hose 70 may be further securely fixed to the sensor holding portion 80.

According to the embodiment, the engagement portions 82 are provided at the sensor holding portion 80 so as to engage with the upper surface 41*a* (engagement section) provided at the pressure sensor 40 in the opposite direction (A1 direction) to the insertion direction (A2 direction) of the pressure sensor 40 relative to the hose 70. Thus, with the engagement portions 82, the pressure sensor 40 is inhibited from moving in the A1 direction relative to the sensor holding portion 80 (i.e., looseness of the pressure sensor 40 relative to the sensor holding portion 80 is restrained). As compared to a case where the pressure sensor 40 is fixed by means of a bolt and a nut, the engagement portions 82 are simply engaged with the pressure sensor 40, which restrains time for a process of stabilizing or fixing the pressure sensor 40 and secures fixation of the pressure sensor 40 to the sensor holding portion 80.

According to the embodiment, the pair of engagement portions 82 is arranged facing each other in the first direction (B direction) orthogonal to the A2 direction. Because of the pair of engagement portions 82, the pressure sensor 40 is restrained from moving in the B direction in addition to the A1 direction relative to the sensor holding portion 80 (i.e., looseness of the pressure sensor 40 is restrained).

According to the embodiment, the pair of retention portions 83 retaining to sandwich the respective flange portions 43 of the pressure sensor 40 in the C direction is arranged facing each other in the B direction in the plan view from the A2 direction. Thus, with the pair of retention portions 83, the pressure sensor 40 is restrained from moving in the A2 direction and the C direction relative to the sensor holding portion 80. Because of the pair of engagement portions 82 and the pair of retention portions 83, the pressure sensor 40 is restrained from moving in any of the A1 direction, the B direction, and the C direction relative to the sensor holding portion 80 (i.e., looseness of the pressure sensor 40 relative to the sensor holding portion 80 is restrained). The pressure sensor 40 may be further securely fixed to the sensor holding portion 80. Because of the pair of retention portions 83 facing each other in the B direction, the pressure sensor 40 is further restrained from moving in the C direction relative to the sensor holding portion 80.

According to the embodiment, the hose 70 is connected to the detection bore 61*a* and the sensor holding portion 80 while curving. In addition, the pressure sensor 40 is pressed against the retention portions 83 by means of the elastic force of the hose 70 which is curving. Because of the elastic force of the curving hose 70 and the contact with the retention portions 83, the pressure sensor 40 is restrained from moving in a direction where the pressure sensor 40 is pressed, i.e., in the C direction (i.e., looseness of the pressure sensor 40 in the C direction is restrained).

According to the embodiment, the sensor holding portion 80 is integrally formed with the intake manifold 6 made of resin. As compared to a case where the sensor holding portion 80 is separately provided, a process for mounting the sensor holding portion 80 at the intake manifold 6 is not necessary, which reduces an assembly process of the air intake apparatus 100. In addition, as compared to a case where the sensor holding portion 80 is separately provided, a clearance is inhibited from being generated between the sensor holding portion 80 and the intake manifold 6, which restrains decrease in detection accuracy of the pressure sensor 40 caused by looseness resulting from the aforementioned clearance.

The embodiment is not limited to include the aforementioned configurations and may be appropriately changed or modified.

Figure 11:
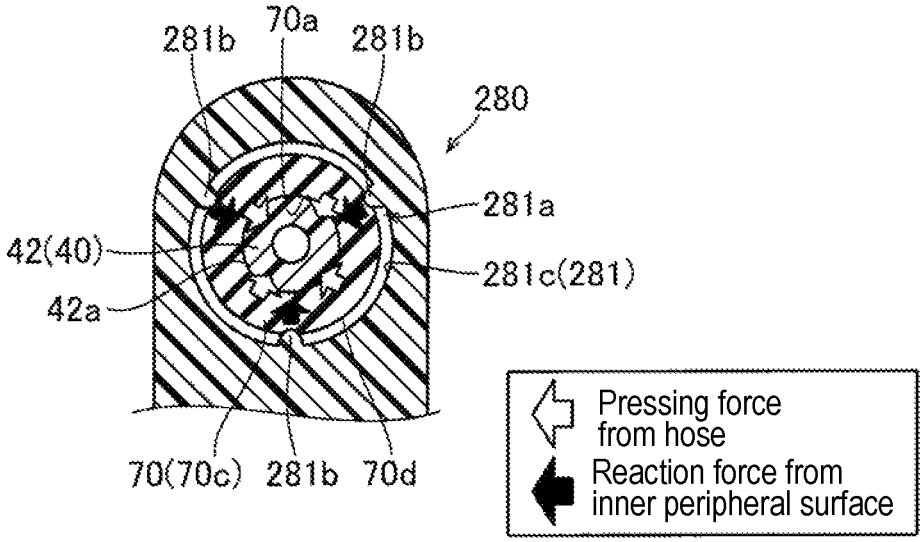
FIG. 11 a cross-sectional view illustrating a hose and a sensor holding portion of an air intake apparatus and a pressure sensor according to a first example of the embodiment.

For example, in addition to the fitting portion 81 of the sensor holding portion 80 in the aforementioned embodiment, protruding portions 281*b* each of which serves as an example of a fitting portion protrusion and each of which protrudes inwardly from an inner peripheral surface 281*c* may be provided at an inner peripheral portion 281*a* of a fitting portion 281 as illustrated in FIG. 11 according to a first modified example. In the first modified example, the plural (for example, three) protruding portions 281*b* are arranged at substantially equal angles (120 degrees) on a cross-section orthogonal to the A direction (see FIG. 8). In this case, the hose 70 which is pushed out in a state where the insertion portion 42 is inserted to be positioned within the hose 70 makes contact with the protruding portions 281*b* of the inner peripheral portion 281*a* of the fitting portion 281, so that the hose 70 and the pressure sensor 40 are fixed to a sensor holding portion 280. Accordingly, a clearance between the inner peripheral surface 281*c* of the fitting portion 281 and the hose 70 may be sufficiently secured. The hose 70 may be easily arranged within the fitting portion 281, and the hose 70 which is pushed out and widened may securely make contact with the protruding portions 281*b* of the inner peripheral portion 281*a*.

In the first modified example, the three protruding portions 281*b* are provided at the inner peripheral portion 281*a* as an example. Alternatively, one, two, four, or more than four protruding portions 281*b* may be provided. In a case where two, four, or more than four protruding portions are provided at the inner peripheral portion, the protruding portions may be arranged at even intervals so as to uniformly apply a pressing force to the hose.

Figure 12:
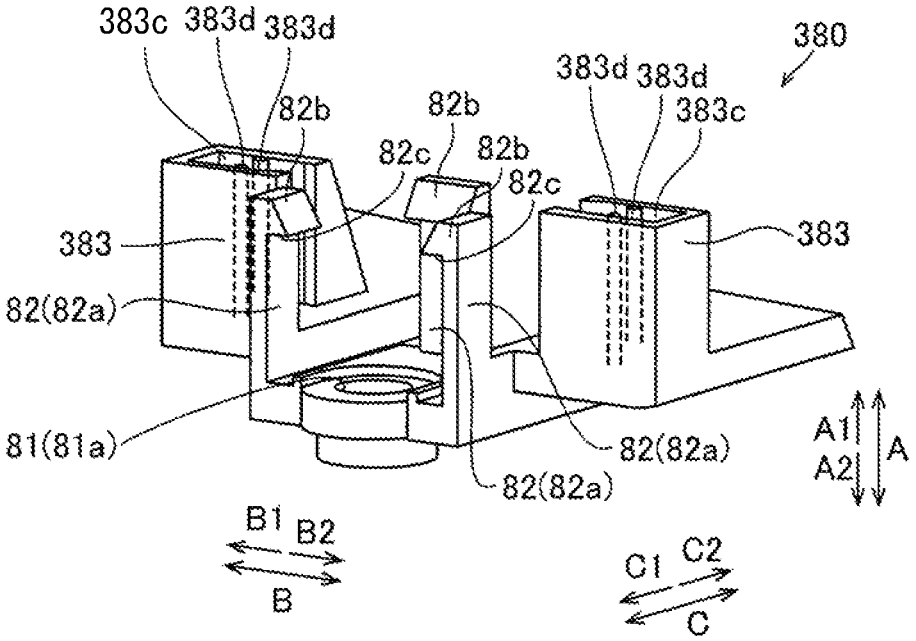
FIG. 12 is a perspective view illustrating a sensor holding portion of an air intake apparatus according to a second example of the embodiment.

In addition to the retention portions 83 of the sensor holding portion 80, protruding portions 383*d* each of which serves as an example of a retention portion protrusion and each of which protrudes inwardly from an inner surface of a receiving portion 383*c* may be provided at the receiving portion 383*c* of a retention portion 383 as illustrated in FIG. 12 according to a second modified example. Specifically, a pair of protruding portions 383*d* is arranged at respective inner surfaces opposed in the C direction of the receiving portion 383*c* of each of the retention portions 383 so as to face each other and protrudes in the C direction. The pair of protruding portions 383*d* is also formed to extend to a bottom surface of a sensor holding portion 380 at the A2 side along the A direction.

In this case, the flange portions 43 (see FIG. 4) of the pressure sensor 40 are inserted to be positioned within respective receiving portions 383*c* so that the pressure sensor 40 is held and sandwiched in the C direction. Accordingly, a clearance between the inner surface of the receiving portion 383*c* and the flange portion 43 is sufficiently secured. While the flange portion 43 is easily arranged within the receiving portion 383*c*, the flange portion 43 may be securely held at the protruding portions 383*d* by making contact therewith.

In the second modified example, the pair of protruding portions 383*d* is arranged at the respective inner surfaces opposed in the C direction of the receiving portion 383*c* so as to face each other and protrudes in the C direction as an example. Alternatively, one, three, or more than three protruding portions (retention portion protrusions) may be provided at the inner surface of the receiving portion.

In the embodiment, the pressure sensor 40 serves as an example of a sensor for measuring a state of intake air flowing through the intake passage. As long as a sensor measures a state of intake air flowing through the intake passage, a sensor other than the pressure sensor may be employed. For example, a temperature sensor measuring a temperature of intake air flowing through the intake passage may be employed.

In the embodiment, the pair of engagement portions 82 is provided facing each other in the B direction (first direction) orthogonal to the insertion direction (A2 direction) and the single engagement portion 82 is provided at the C2 side (in the second direction). That is, the three engagement portions 82 in total are provided. Alternatively, the pair of engagement portions may be provided facing each other in a direction orthogonal to the insertion direction (first direction) and may not be provided in the second direction. In addition, one, four, or more than four engagement portions may be provided.

In the embodiment, the pair of retention portions 83 is provided sandwiching the fitting portion 81 in the B direction (the first direction orthogonal to the insertion direction). Alternatively, the pair of retention portions may be provided facing each other in the C direction (the second direction orthogonal to the first direction) in FIG. 6. In addition, one, three, or more than three retention portions may be provided.

In the embodiment, the fitting portion 81, the engagement portions 82, and the retention portions 83 are provided at the sensor holding portion 80. The configuration is not limited thereto and a configuration that at least the fitting portion is provided at the sensor holding portion may be available. In addition, a tapping screw may be employed instead of the engagement portions to cause the air intake apparatus body made of resin and the sensor to be meshed with each other by internal thread-forming. In this case, a clearance may be generated between the sensor and the air intake apparatus body because of insufficient engagement of the sensor by the tapping screw resulting from creep phenomenon which occurs at the internal thread-formed portion of the air intake apparatus body made of resin. Nevertheless, according to the embodiment, the hose 70 (pipe member) fixed to the fitting portion 81 restrains looseness resulting from the aforementioned clearance from occurring at the sensor.

In the embodiment, the intake pressure (the state of intake air) within the intake passage 64 at the intake manifold 6 (air intake apparatus body) where the EGR gas is introduced to the intake passage 64 is measured by the pressure sensor 40. Alternatively, the state of intake air which is compressed within the intake passage at the air intake apparatus body where the intake air compressed by a supercharger is introduced to the intake passage may be measured by the sensor.

According to the disclosure, an air intake apparatus 100 includes an intake manifold 6 including an intake passage 64 which is connected to a combustion chamber 5 of an engine body 10 to supply an intake air to the combustion chamber 5 and a detection bore 61*a* communicating between the intake passage 64 and an outside of the intake manifold 6, a sensor holding portion 80, 280, 380 provided at the outside of the intake manifold 6 to hold a pressure sensor 40 which measures a state of an intake air flowing through the intake passage 64, a hose 70 constituted by an elastic member and including a first end 70*b* and a second end 70*c*, the first end 70*b* being connected to the detection bore 61*a* and the second end 70*c* being connected to the sensor holding portion 80, 280, 380, the sensor holding portion 80, 280, 380 including a fitting portion 81, 281 which includes an inner peripheral surface 81*a*, 281*a* contactable with an outer peripheral surface 70*d* of the second end 70*c* of the hose 70, the pressure sensor 40 and the hose 70 being fixed to the sensor holding portion 80, 280, 380 by a contact of the outer peripheral surface 70*d* of the second end 70*c* of the hose 70 with the inner peripheral surface 81*a*, 281*a* of the fitting portion 81, 281 in a state where an insertion portion 42 of the pressure sensor 40 is inserted to be positioned within the second end 70*c* of the hose 70 to widen the second end 70*c*.

In addition, the outer peripheral surface 70*d* of the second end 70*c* of the hose 70 is in contact with the inner peripheral surface 81*a*, 281*a* of the fitting portion 81, 281 in a state of being elastically deformed.

Further, the second end 70*c* of the hose 70 includes a thickness ta in a state where the second end 70*c* is widened, the thickness ta being smaller than a thickness t of the second end 70*c* obtained before the second end 70*c* is widened.

Furthermore, the sensor holding portion 80, 280, 380 includes an engagement portion 82 which engages with an upper surface 41*a* (engagement section) of the pressure sensor 40, the upper surface 41*a* being formed in an opposite direction to an insertion direction (A2 direction) of the pressure sensor 40 relative to the hose 70.

Furthermore, the engagement portion includes a pair of engagement portions 82 facing each other in a first direction (B direction) orthogonal to the insertion direction of the pressure sensor 40 relative to the hose 70.

Furthermore, the sensor holding portion 80, 280, 380 includes a retention portion 83, 383 retaining a flange portion 43 of the pressure sensor 40 in a second direction (C direction) orthogonal to the first direction. The retention portion 83, 383 includes first and second retention portions 83*a*, 83*b*, 383*a*, 383*b* facing each other in the first direction in a plan view viewed from the insertion direction.

Furthermore, the hose 70 is connected to the detection bore 61*a* and the sensor holding portion 80, 280, 380 in a state where the hose 70 is curved, the retention portion 83, 383 against which the pressure sensor 40 is pressed by an elastic force of the hose 70 which is curved.

Furthermore, the sensor holding portion 280 includes a fitting portion protrusion 281*b* provided at the inner peripheral portion 281*a* of the fitting portion 281 to protrude inwardly.

Furthermore, the sensor holding portion 380 includes a retention portion protrusion 383*d* protruding inwardly from an inner surface of the retention portion 383.

Furthermore, the intake manifold 6 is made of resin, the sensor holding portion 80, 280, 380 being integrally formed at the intake manifold 6 made of resin.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An air intake apparatus comprising:

an air intake apparatus body including an intake passage which is connected to a combustion chamber of an internal combustion engine body to supply an intake air to the combustion chamber and a detection bore communicating between the intake passage and an outside of the air intake apparatus body;

a sensor holding portion provided at the outside of the air intake apparatus body to hold a sensor which measures a state of an intake air flowing through the intake passage;

a pipe member constituted by an elastic member and including a first end and a second end, the first end being connected to the detection bore and the second end being connected to the sensor holding portion, the sensor holding portion including a fitting portion which includes an inner peripheral portion contactable with an outer peripheral portion of the second end of the pipe member, the sensor and the pipe member being fixed to the sensor holding portion by a contact of the outer peripheral portion of the second end of the pipe member with the inner peripheral portion of the fitting portion in a state where an insertion portion of the sensor is inserted to be positioned within the second end of the pipe member to widen the second end.

2. The air intake apparatus according to claim 1, wherein the outer peripheral portion of the second end of the pipe member is in contact with the inner peripheral portion of the fitting portion in a state of being elastically deformed.

3. The air intake apparatus according to claim 2, wherein the second end of the pipe member includes a thickness in a state where the second end is widened, the thickness being smaller than a thickness of the second end obtained before the second end is widened.

4. The air intake apparatus according to claim 1, wherein the sensor holding portion includes an engagement portion which engages with an engagement section of the sensor, the engagement section being formed in an opposite direction to an insertion direction of the sensor relative to the pipe member.

5. The air intake apparatus according to claim 4, wherein the engagement portion includes a pair of engagement portions facing each other in a first direction orthogonal to the insertion direction of the sensor relative to the pipe member.

6. The air intake apparatus according to claim 5, wherein the sensor holding portion includes a retention portion retaining a flange portion of the sensor in a second direction orthogonal to the first direction, the retention portion includes first and second retention portions facing each other in the first direction in a plan view viewed from the insertion direction.

7. The air intake apparatus according to claim 6, wherein the pipe member is connected to the detection bore and the sensor holding portion in a state where the pipe member is curved, the sensor is pressed to the retention portion by an elastic force of the pipe member which is curved.

8. The air intake apparatus according to claim 1, wherein the sensor holding portion includes a fitting portion protrusion provided at the inner peripheral portion of the fitting portion to protrude inwardly.

9. The air intake apparatus according to claim 6, wherein the sensor holding portion includes a retention portion protrusion protruding inwardly from an inner surface of the retention portion.

10. The air intake apparatus according to claim 1, wherein the air intake apparatus body is made of resin, the sensor holding portion being integrally formed at the air intake apparatus body made of resin.

11. The air intake apparatus according to claim 2, wherein the sensor holding portion includes an engagement portion which engages with an engagement section of the sensor, the engagement section being formed in an opposite direction to an insertion direction of the sensor relative to the pipe member.

12. The air intake apparatus according to claim 11, wherein the engagement portion includes a pair of engagement portions facing each other in a first direction orthogonal to the insertion direction of the sensor relative to the pipe member.

13. The air intake apparatus according to claim 12, wherein the sensor holding portion includes a retention portion retaining a flange portion of the sensor in a second direction orthogonal to the first direction, the retention portion includes first and second retention portions facing each other in the first direction in a plan view viewed from the insertion direction.

14. The air intake apparatus according to claim 13, wherein the pipe member is connected to the detection bore and the sensor holding portion in a state where the pipe member is curved, the sensor is pressed to the retention portion by an elastic force of the pipe member which is curved.

15. The air intake apparatus according to claim 13, wherein the sensor holding portion includes a retention portion protrusion protruding inwardly from an inner surface of the retention portion.

16. The air intake apparatus according to claim 3, wherein the sensor holding portion includes an engagement portion which engages with an engagement section of the sensor, the engagement section being formed in an opposite direction to an insertion direction of the sensor relative to the pipe member.

17. The air intake apparatus according to claim 16, wherein the engagement portion includes a pair of engagement portions facing each other in a first direction orthogonal to the insertion direction of the sensor relative to the pipe member.

18. The air intake apparatus according to claim 17, wherein the sensor holding portion includes a retention portion retaining a flange portion of the sensor in a second direction orthogonal to the first direction, the retention portion includes first and second retention portions facing each other in the first direction in a plan view viewed from the insertion direction.

19. The air intake apparatus according to claim 18, wherein the pipe member is connected to the detection bore and the sensor holding portion in a state where the pipe member is curved, the sensor is pressed to the retention portion by an elastic force of the pipe member which is curved.

20. The air intake apparatus according to claim 18, wherein the sensor holding portion includes a retention portion protrusion protruding inwardly from an inner surface of the retention portion.

* * * * *